US011581004B2

(12) United States Patent
Pivnicka et al.

(10) Patent No.: US 11,581,004 B2
(45) Date of Patent: Feb. 14, 2023

(54) DYNAMIC VOICE ACCENTUATION AND REINFORCEMENT

(71) Applicant: HearUnow, Inc., Woodside, CA (US)

(72) Inventors: Richard Pivnicka, Woodside, CA (US); Michael Klasco, Richmond, CA (US)

( * ) Notice: Subject to any disclaimer, the term of this patent is extended or adjusted under 35 U.S.C. 154(b) by 0 days.

(21) Appl. No.: 17/535,253

(22) Filed: Nov. 24, 2021

(65) Prior Publication Data

US 2022/0172734 A1 Jun. 2, 2022

Related U.S. Application Data

(60) Provisional application No. 63/120,554, filed on Dec. 2, 2020.

(51) Int. Cl.
*G10L 21/0232* (2013.01)
*H04R 3/04* (2006.01)
*G10L 25/84* (2013.01)

(52) U.S. Cl.
CPC ..... *G10L 21/0232* (2013.01); *G10L 25/84* (2013.01); *H04R 3/04* (2013.01)

(58) Field of Classification Search
CPC ..... G10L 21/0232; G10L 25/84; H04R 3/04
See application file for complete search history.

(56) References Cited

U.S. PATENT DOCUMENTS 3,236,949 A 2/1966 Atal
4,628,528 A 12/1986 Bose
4,658,425 A * 4/1987 Julstrom ..... H04M 3/569 379/206.01
4,837,832 A 6/1989 Fanshel
5,051,964 A 9/1991 Sasaki
5,357,578 A 10/1994 Taniishi
5,404,406 A 4/1995 Fuchigami
5,600,727 A 2/1997 Sibbald
5,619,582 A 4/1997 Oitman
6,052,336 A 4/2000 Lowrey
(Continued)

FOREIGN PATENT DOCUMENTS

JP 2017085445 A * 5/2017

OTHER PUBLICATIONS

Kinsler et al., "Fundamentals of Acoustics," Third Edition, John Wiley & Sons, New York, NY, 1982, Reviewed by H. Saunders, 2 pages.

(Continued)

*Primary Examiner* — Michelle M Koeth

(57) ABSTRACT

Systems and methods for dynamic voice accentuation and reinforcement are presented herein. One embodiment comprises one or more audio input sources; one or more audio output sources; one or more band pass filters; and a processing control unit that includes an audio processing unit, and which executes a method: differentiating between audio input sources as vocal sound audio input sources and ambient noise audio input sources; increasing the gain of the vocal sound audio input sources; inverting a polarity of an ambient noise signal received by each of the ambient noise audio input sources; and adding the inverted polarity to either an output signal of at least one of the one or more audio output sources, or to an input signal of at least one of the vocal sound audio input sources, to reduce ambient noise.

22 Claims, 8 Drawing Sheets

(56) References Cited

U.S. PATENT DOCUMENTS

| | | | | |
|---|---|---|---|---|
| 6,122,389 | A | 9/2000 | Grosz | |
| 6,445,804 | B1 | 9/2002 | Hirayanagi | |
| 6,584,138 | B1 | 6/2003 | Neubauer | |
| 6,661,907 | B2 | 12/2003 | Ho | |
| 6,760,447 | B1 | 7/2004 | Nelson | |
| 6,999,715 | B2 | 2/2006 | Hayter | |
| 7,003,135 | B2 | 2/2006 | Hsieh | |
| 7,035,700 | B2 | 4/2006 | Gopalan | |
| 7,062,050 | B1 | 6/2006 | Pompei | |
| 7,110,553 | B1 | 9/2006 | Julstrom | |
| 7,146,028 | B2 | 12/2006 | Lestideau | |
| 7,218,759 | B1 | 5/2007 | Ho | |
| 7,457,430 | B2 | 11/2008 | Kirovski | |
| 7,460,693 | B2 | 12/2008 | Loy | |
| 7,460,695 | B2 | 12/2008 | Steinberg | |
| 7,881,939 | B2 * | 2/2011 | Tice | H04M 11/007 704/223 |
| 8,154,588 | B2 | 4/2012 | Burns | |
| 9,117,455 | B2 * | 8/2015 | Tracey | G10L 21/003 |
| 10,356,362 | B1 * | 7/2019 | Rudberg | H04R 5/04 |
| 11,227,623 | B1 * | 1/2022 | Vitt | H04R 5/027 |
| 2001/0029449 | A1 | 10/2001 | Tsurufuji | |
| 2003/0059061 | A1 | 3/2003 | Tsuji | |
| 2003/0108334 | A1 | 6/2003 | Nevenka | |
| 2003/0154084 | A1 | 8/2003 | Li et al. | |
| 2003/0169907 | A1 | 9/2003 | Edwards | |
| 2006/0062401 | A1 | 3/2006 | Neervoort | |
| 2007/0223710 | A1 | 9/2007 | Laurie | |
| 2007/0230743 | A1 | 10/2007 | Mannerheim | |
| 2007/0297620 | A1 * | 12/2007 | Choy | H04R 3/04 381/73.1 |
| 2010/0177178 | A1 | 7/2010 | Burns | |
| 2016/0071525 | A1 | 3/2016 | Di Censo et al. | |
| 2016/0307581 | A1 | 10/2016 | Salmela | |
| 2017/0214997 | A1 | 7/2017 | Kaller et al. | |
| 2017/0332171 | A1 * | 11/2017 | Kim | G10K 11/17873 |
| 2017/0354796 | A1 * | 12/2017 | Gussen | G10K 11/17875 |
| 2018/0176682 | A1 | 6/2018 | Goesnar et al. | |
| 2020/0059241 | A1 * | 2/2020 | Perrott | H04W 52/0251 |
| 2020/0152218 | A1 | 5/2020 | Kikuhara et al. | |
| 2021/0193162 | A1 * | 6/2021 | Hook | G10L 17/00 |
| 2021/0350823 | A1 * | 11/2021 | Wexler | G10L 15/07 |
| 2021/0375253 | A1 * | 12/2021 | Turner-Fernback | G10K 11/17873 |

OTHER PUBLICATIONS

Westervel, Peter J., "Parametric Acoustical Array," Journal of the Acoustical Society of America, vol. 35, No. 4, Apr. 1963, 4 pages.

Barbagallo et al., "Modulation and Demodulation of Steerable Ultrasound Beams for Audio Transmission and Rendering," Proc. Of the 11th Int. Conference on Digital Audio Effects (DAFx-08), Espoo, Finland, Sep. 1-4, 2008, 6 pages.

Rodman, Jeff, "The effect of bandwidth on speech intelligibility", Polycon White Paper, Polycom Inc, 2003, [online]; available at: <URL:http://www.polycom.com/common/documents/support/technical/products/voice/s oundstationvtx.1000 wp effect bandwidth speech intelligibility.pdf, [accessed Dec. 6, 2021], 9 pages.

Bogholm, Niels, "The Surface Microphone, Principles and Aerospace Applications", Aerospace Testing Expo 2005, Long Beach , California, November 8-10, copy not available.

Garcia, Richard, "Digital Watermarking of Audio Signals Using a Psychoacoustic Auditory Model and Spread Spectrum Theory," University of Miami, Apr. 21, 1999, 42 pages.

Tiki, John F. et al., "Encoding a Hidden Auxiliary Channel Onto a Digital Audio Signal Using Psychoacoustic Masking", Proceedings IEEE Southeastcon '97. 'Engineering the New Century'; Apr. 12-14, 1997, 1 page [abstract only].

Donath et al., "Visiphone," MIT Media Lab, Cambridge, MA 02138 , [online]; available at: <URL:http://alumni.media.mit.edu/~fviegas/papers/visiphone.icad.2000.pdf>, [accessed Dec. 6, 2021], 4 pages.

"International Search Report" and "Written Opinion", Patent Cooperation Treaty Application No. PCT/US2021/060850, dated Feb. 14, 2022, 11 pages.

* cited by examiner

DYNAMIC VOICE ACCENTUATION AND REINFORCEMENT

CROSS-REFERENCES TO RELATED APPLICATIONS

The present application claims the priority benefit of U.S. Provisional Patent Application No. 63/120,554, filed on Dec. 2, 2020, and titled "Dynamic Voice Accentuation and Reinforcement", which is hereby incorporated by reference in its entirety.

The present application is related to U.S. Pat. No. 8,154,588, issued on Apr. 10, 2012, and titled "Participant Audio Enhancement System", which is hereby incorporated by reference in its entirety.

FIELD OF INVENTION

The present technology pertains to voice accentuation, reinforcement and improving the quality, intelligibility, and audibility of in-person voice-based group conversations. In particular, but not by way of limitation, the present technology provides systems, and methods for dynamic voice accentuation and reinforcement.

SUMMARY

In various embodiments the present technology is directed to a system for improving speech intelligibility in a group setting, the system comprising: one or more audio input sources, wherein each of the one or more audio input sources may be associated with one or more individuals; one or more audio output sources, wherein each of the one or more audio output sources may be associated with one or more individuals and have their output signal amplified if the associated one or more individuals are actively listening; one or more band pass filters; and a processing control unit, the processing control unit coupled to the one or more audio input sources and one or more audio output sources, wherein the processing control unit executes a method to improve speech intelligibility, the method comprising: differentiating between audio input sources as vocal sound audio input sources and ambient noise audio input sources; increasing the gain of the vocal sound audio input sources; inverting a polarity of an ambient noise signal received by each of the ambient noise audio input sources; and adding the inverted polarity to either an output signal of at least one of the one or more audio output sources, or to an input signal of at least one of the vocal sound audio input sources, to reduce ambient noise; the processing control unit comprising: an audio processing unit, to process audio input signals to audio output signals.

In several embodiments the system further comprises one or more of any of a preamplifier, a network interface, a digital signal processor, a power source, an automatic microphone mixer, a notch-type feedback suppressor, a digital signal processor, a multichannel digital to analog converter, a multichannel analog to digital converter, one or more visual sensors, a frame grabber, a video processing unit, and a wireless transmitter.

BRIEF DESCRIPTION OF THE DRAWINGS

In the description, for purposes of explanation and not limitation, specific details are set forth, such as particular embodiments, procedures, techniques, etc. to provide a thorough understanding of the present technology. However, it will be apparent to one skilled in the art that the present technology may be practiced in other embodiments that depart from these specific details.

The accompanying drawings, where like reference numerals refer to identical or functionally similar elements throughout the separate views, together with the detailed description below, are incorporated in and form part of the specification, and serve to further illustrate embodiments of concepts that include the claimed disclosure and explain various principles and advantages of those embodiments.

Figure 1:
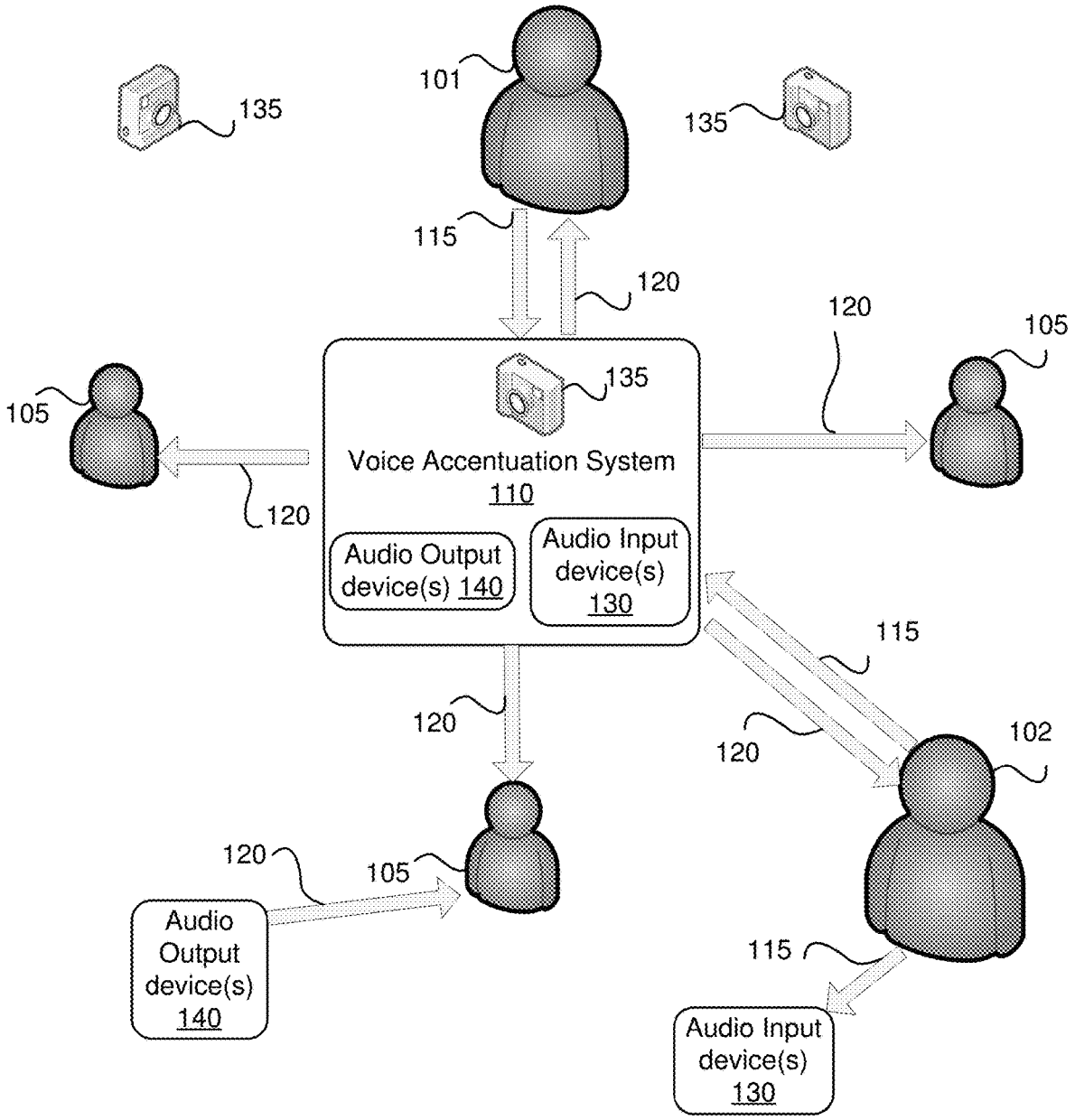

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

FIG. 1 is a schematic representation of an exemplary voice accentuation system in use by multiple users.

Figure 2:
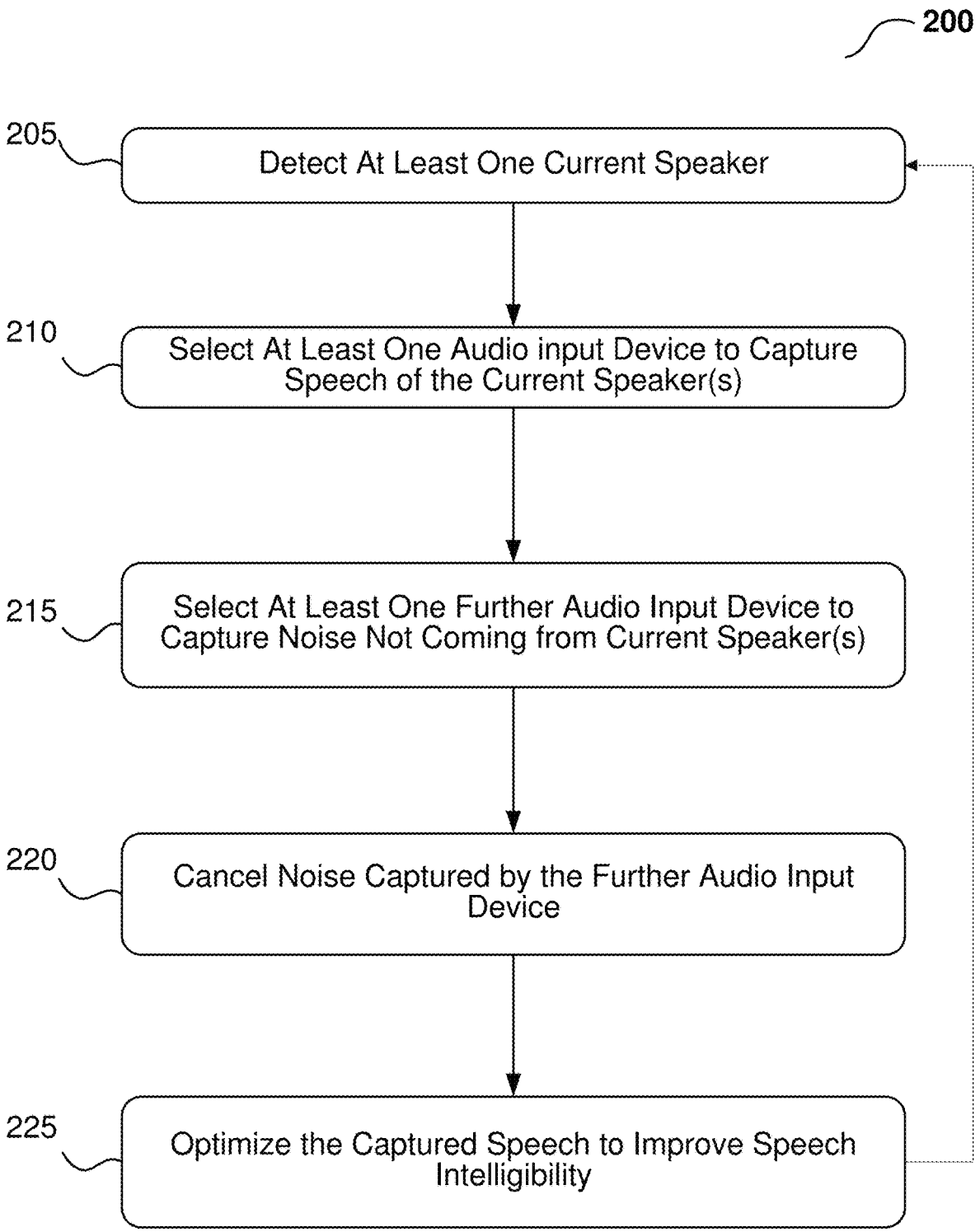

FIG. 2 is a flow diagram of a method to improve the speech intelligibility of a conversation.

Figure 3:
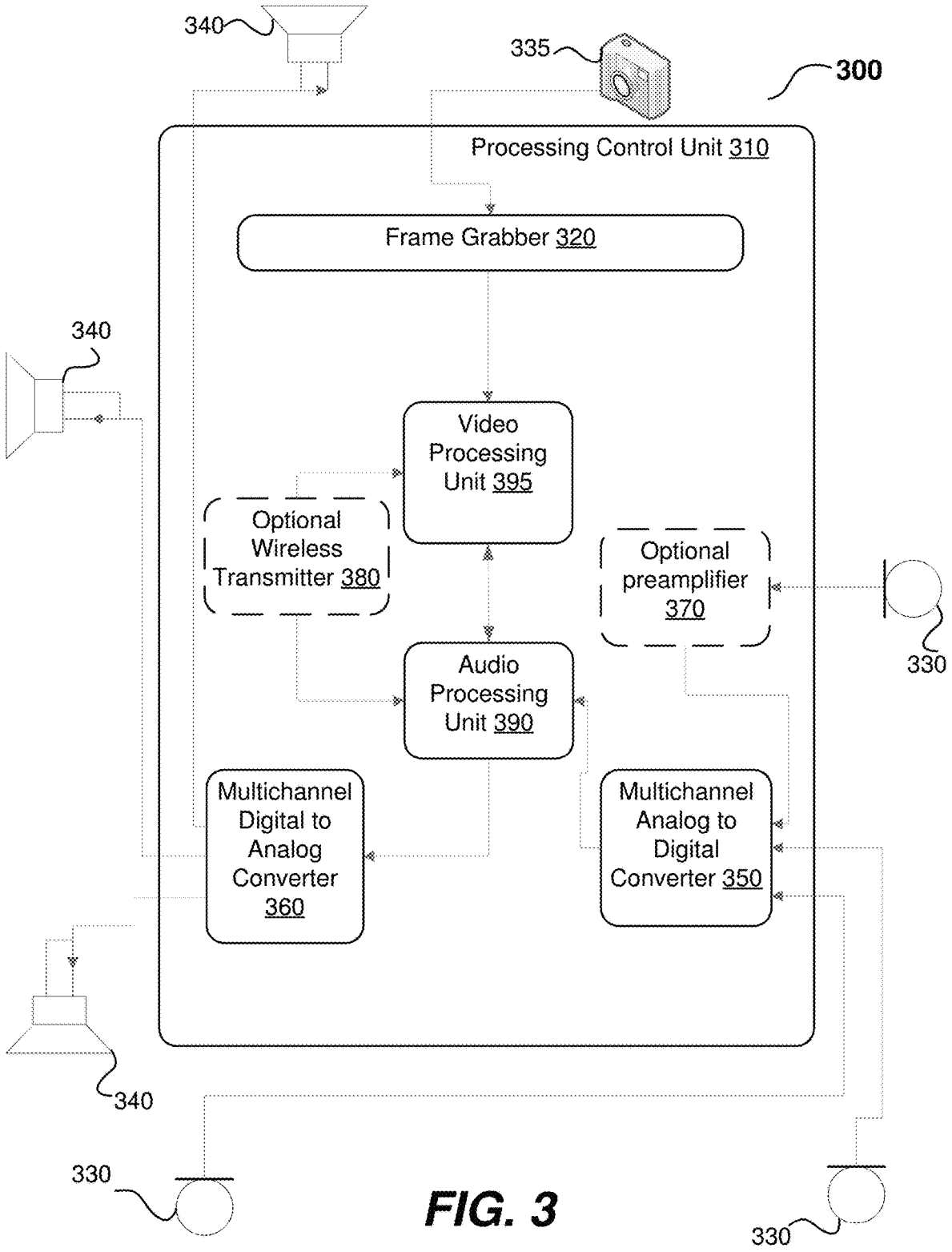

FIG. 3 is a diagrammatical representation of the dynamic voice accentuation and reinforcement system.

Figure 4:
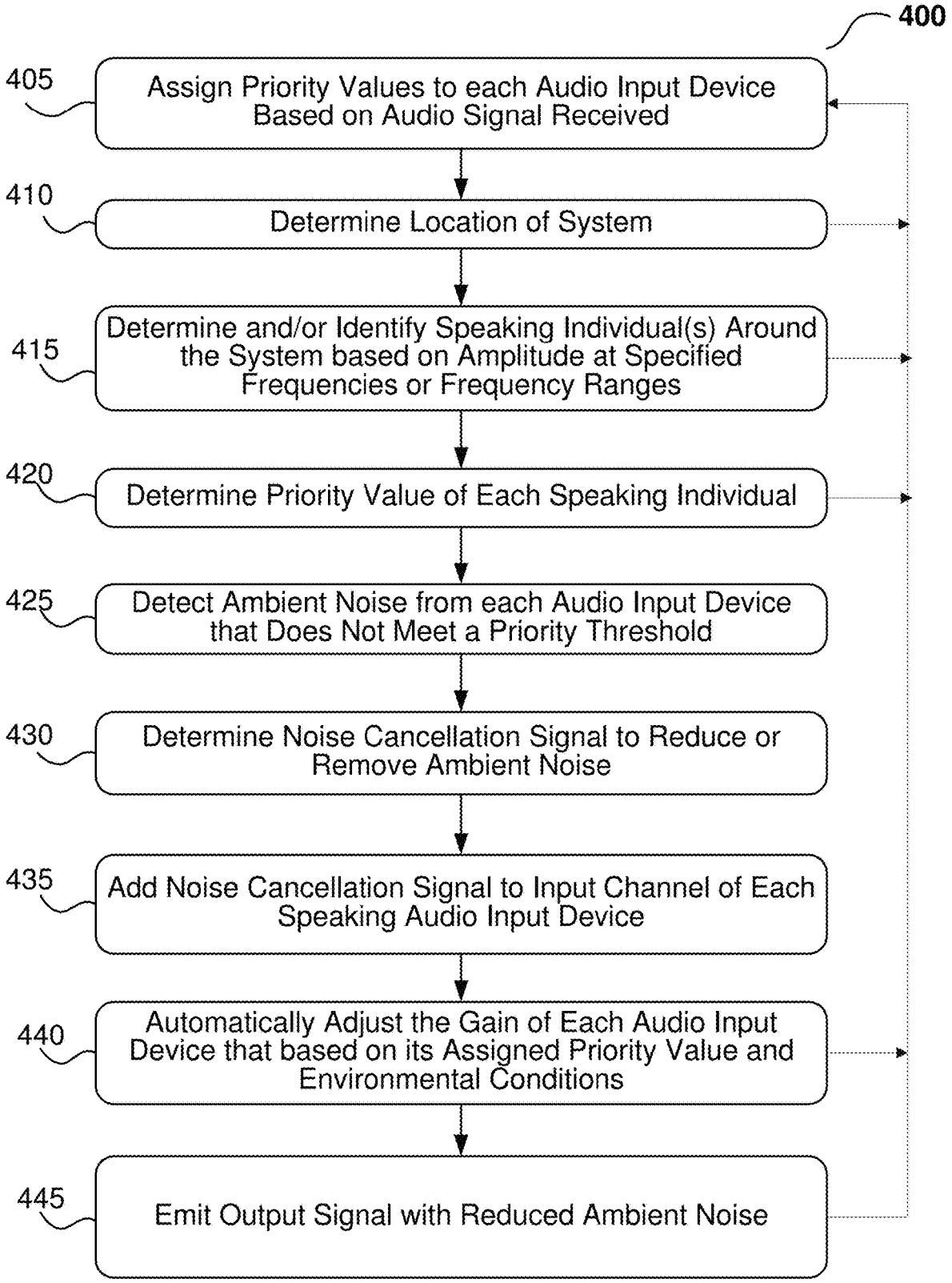

FIG. 4 presents one embodiment of a method to improve intelligibility and minimize ambient noise.

Figure 5A:
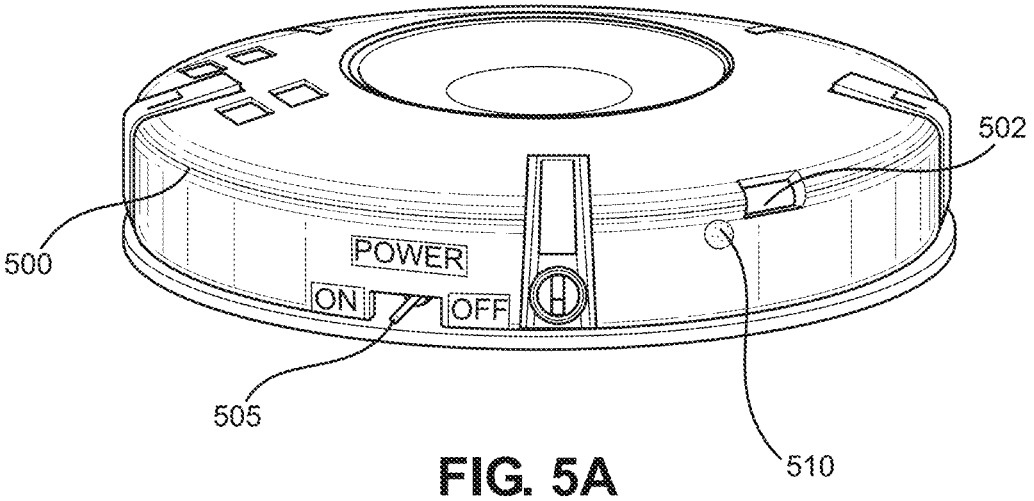
Figure 5B:
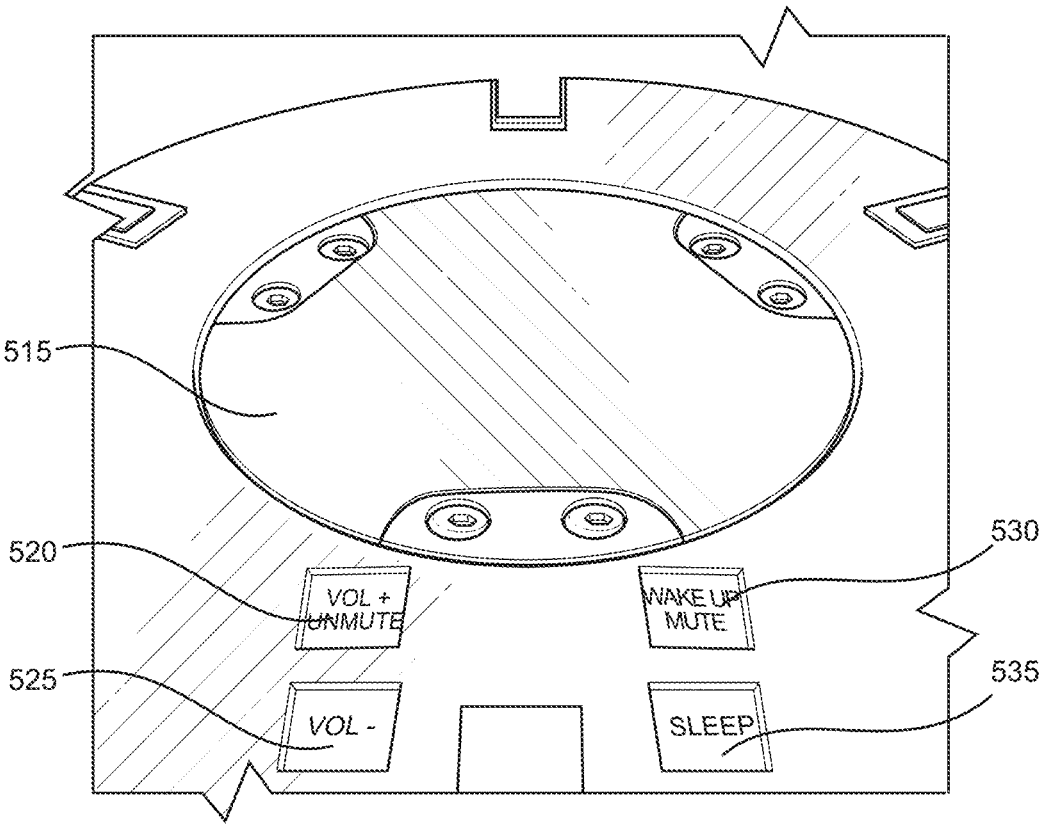

FIGS. 5A-5B present different views of one embodiment of a voice accentuation device.

Figure 6A:
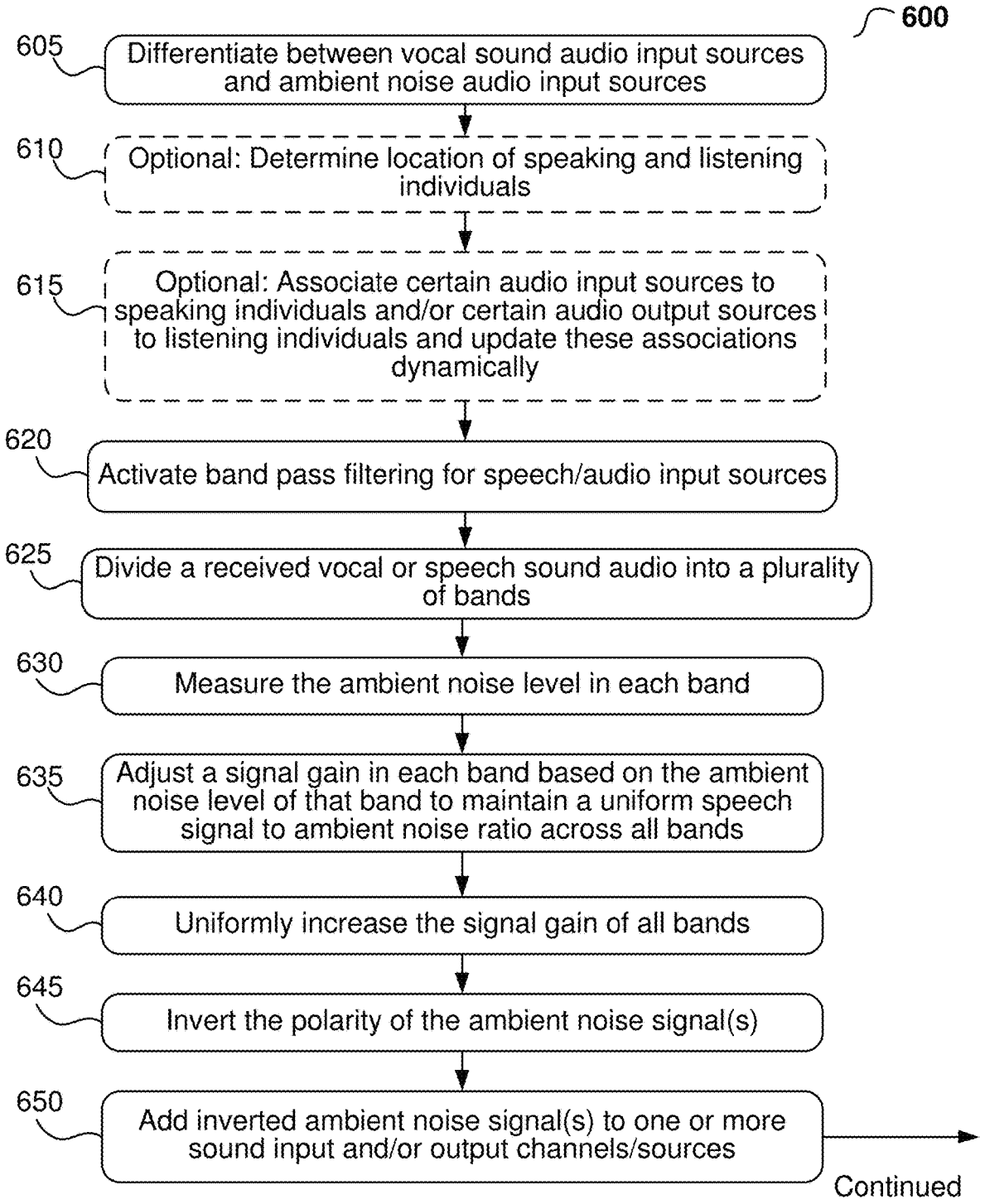
Figure 6B:
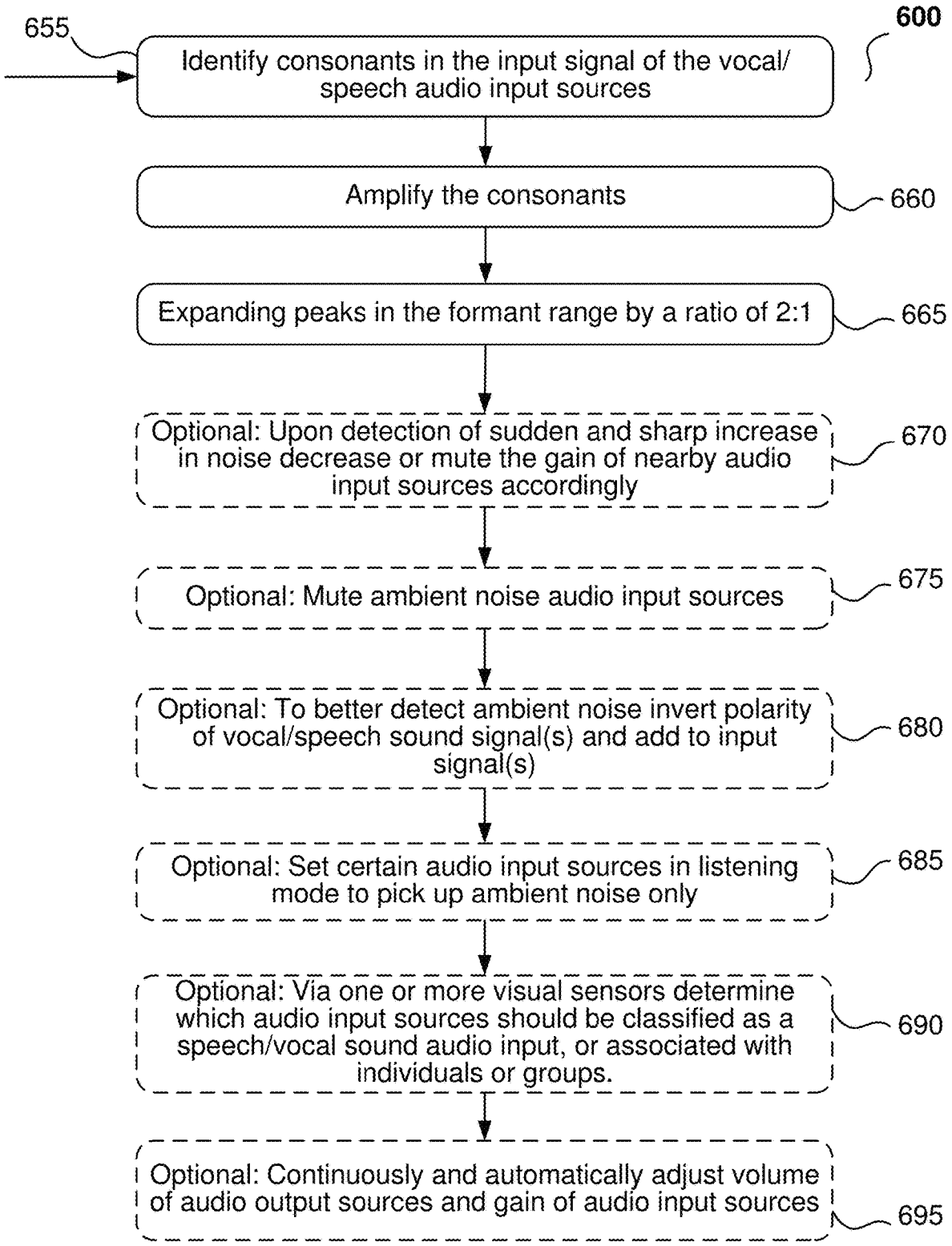

FIGS. 6A-6B present another embodiment of a method to improve intelligibility and minimize ambient noise in a conversation setting.

Figure 7:
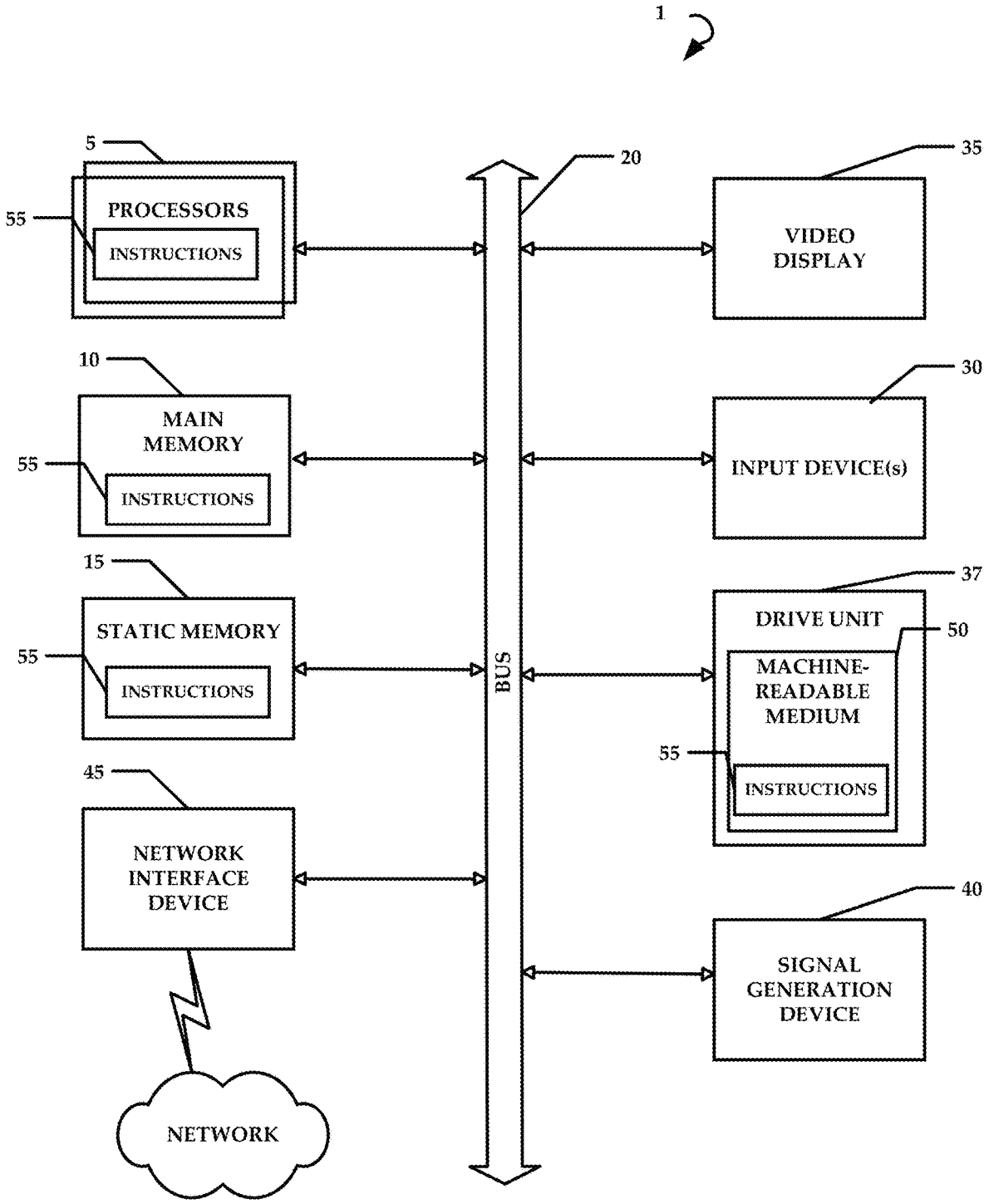

FIG. 7 illustrates a computer system according to exemplary embodiments of the present technology.

DETAILED DESCRIPTION

It is generally accepted that speech intelligibility can be measured by equivalent acoustic distance (EAD), which improves as a listener gets closer to a speaker, or a receiver gets closer to a transmitter, because articulation is improved while consonant/fricative loss is reduced. EAD between a close listener/speaker or receiver/transmitter results in higher and faster comprehension with lower listening fatigue and higher listener retention.

Conversations in noisy or otherwise loud environments, especially in a group setting where there is some distance between speaker(s) and listener(s) can be challenging on all parties involved. Each speaker must contend not only with members of the group, other potential speakers, and other distractions, but must also try to make themselves heard above environmental noise that may emanate from people, nature or man-made devices and machinery. Each listener must also work to listen to the speaker(s) while contending at the same time with sounds coming from the environment, increasing listening fatigue. As EAD increases between speakers and listeners, for example when sitting (further) across a table from each other, then listening comprehension and retention is reduced.

Systems and methods that only increase the volume of an individual speaker may face a number of potential problems, raising gain too much may cause noise spillover to the outside environment, such as adjacent tables or other parts of a conference room, it could also result in acoustic feedback in the system. Other potential problems include systems or devices that are too slow, or have too high of a latency, for example where the sound from a speaking individual is amplified by a system but by the time it is processed by the device, outputted and then received by listener(s), the sound does not match with the speaker's mouth or facial movements creating an unsynchronized effect, which confuses listeners' senses, reducing comprehension. This unsynchronized effect may be disorienting and is undesirable in a professional or conversational setting and serves only to increase listening fatigue. Increased latency may also result in a delay between when the outputted signal reaches the listener and when the direct sound from the speaker reaches the listener, which can likewise be undesired or disorienting.

The voice accentuation and reinforcement systems and methods described in this document aim to improve speech intelligibility between members of a group, preferably 4-10 people during conversations in noisy environments, for example around a table in a restaurant or in conferences, without intruding on or disrupting adjacent tables or the conversations of others. The systems and methods described enable enhanced voice-lift functionality to enable higher speech comprehension by listeners resulting in reduced listening fatigue. They also produce the highest quality of comprehensible speech with the least possible increase in voice-lift or gain, minimizing intrusiveness to the surrounding environment, and preventing acoustic feedback. The systems and methods described are low latency, ensuring that high latency or slow signal processing speeds do not interfere with a listener's comprehension.

One embodiment of the present technology is a table-top system that includes multiple speakers and microphones, in some embodiments this system may be fully contained within or include one primary or central device (referred to herein as the "voice accentuation device") capable of carrying out all the functionalities of the system as described in this document. Any type of microphone with any directional pattern may be used, including and not limited to cardioid, super/hyper cardioid, shotgun, FIG. 8 or omnidirectional microphones. The microphones may also be capable of multiple modes and patterns and may be able to adjust their mode or pattern automatically based on their intended function at the time. They may also include a microphone preamp. The speakers the system employs may also be of various kinds including and not limited to parametric loudspeakers, electrostatic loudspeakers, piezoelectric speakers, bending wave loudspeakers, other loudspeakers, and the like. In some embodiments, the microphones and/or speakers may be plug-n-play devices or wirelessly connected smart devices, cellular phones, tablets or other input or output audio devices.

The system or the voice accentuation device may take a variety of formfactors including a round, circular, or disc-shaped form with speakers and microphones arranged on, as part of, and/or around the circumference of the system. The system may also be square or rectangular in shape and may use a phased speaker array on all or any side. Microphones may be arranged in an array, including phased arrays or arrays used for beamforming, or they may be placed around the system and/or around the table. Microphones may be directional and point at different regions radially away from the center of the system. The microphones may also be moveable and/or rotatable on the system itself, or in other embodiments where the microphones are not directly placed on the system, they may be manually placed in custom configurations and arrays on a table, ceiling, wall, ground or around the system.

The strategies and goals that are the core of the invention may be applied to other application-specific environments such as conferences in a business jet or other vehicles—where the microphone and speaker locations would be determined by the positions of the speaking individual(s) and listener(s) and the acoustic space.

The system may also include a camera or multiple cameras or other visual sensor devices that capture and/or process visual data. These may be of any kind including digital camera, video recording devices, depth of field, infrared or thermal cameras, or other motion or image capture devices and technology.

Embodiments may include the system being placed underneath, above, or incorporated into a table, on or in a wall, ceiling, with microphones, speakers and cameras connected and identified through wired connections or identified and connected wirelessly to the system through one or more of any of the following: Bluetooth, wireless, RFID, LAN, WAN, PAN or other cellular or wireless networks or connections. The device mounted on a ceiling may have several benefits, including the device being protected from spilling of food or beverages, protected from theft by being installed and mounted at an unreachable or difficult to reach height, and providing the advantage of a higher vantage point for visual or camera devices for a wider view at individuals sitting at tables on ground level.

The system may include a processing control unit, that is connected to audio input device(s) (also referred to herein as "audio input source(s)" or "input sources") such as microphones, audio output device(s) (also referred to herein as "audio output source(s)" or "output sources") such as speakers, visual input devices(s) including camera(s) and/or other input and output devices. The processing control unit may include one or more of any of the following: a multichannel digital to analog converter, a multichannel analog to digital converter, a frame grabber, a video digital processor, an audio digital or analog signal processor, a preamplifier, a wireless transmitter, and a network interface. The processor control unit may also include one or more processors, or system on a chip running a digital audio workstation or other software or programs. The system may in some embodiments run on battery power, a direct power source or be capable of both. The battery or other power source may utilize wireless charging, including Qi charging technologies, where the device may be placed on a specific table, mat or other location (or on a specific object) causing the battery to automatically charge. The control unit may be part of a central processing unit, a system-on-a-chip, or any other computing architecture or machine, including the machine embodiments presented in this document.

One embodiment of the system utilizes methods for detecting one or more speaking individuals near the system. Detection of speaking individuals may be undertaken by either audio, visual sensors and/or other input devices or a combination thereof. Input signals and data used to detect speaking individual(s) may include audio and/or visual signals and data. Input signals and data may be processed and analyzed by the processing control unit to determine the location of each individual around the system, the direction each individual is facing, and the mouth, head or facial movements of each individual, and to determine the location of each speaker or listener relative to the system.

In some embodiments optical face recognition technologies are utilized to determine the location and/or status of each individual of interest, i.e., whether they are talkers or listeners, and/or whether they are part of a group or not and should be considered as part of the conversing group or not. Determinations made by optical facial recognition technologies deployed may determine which microphones/audio input sources are turned on, off, suppressed, or to move or turn the microphone array towards or away from certain individuals and/or groups. When the system/device is installed in specific vantage points such as on a ceiling, multiple cameras with different angles and/or heights may be utilized to capture a variety of images and angles. Specific array configurations in response to specific movements or recognized facial features or directionality may be saved in memory.

In some embodiments, the system is able via the processing control unit to compare the gain pickup from each microphone, analyze the voices from each microphone input device, and then determine whether each microphone is near a speaking individual. The system may be able to classify each microphone as a microphone near a speaking individual (speaking microphones), which could be done by assigning values to each microphone based on a variety of factors. Cameras and other visual input devices may also aid in designating microphones and the locations of speakers and listeners, by capturing visual data of facial expressions, head movements, or the movement of the lips.

Microphones and other audio input devices that are designated as being near speaking individuals (speaking microphones) may be selectively amplified, and/or other microphones and other audio input devices not designated as speaking microphones may be suppressed or muted. Directional microphones and associated techniques known to those skilled in the art may be used to enhance the effect(s) and create cleaner input signals for amplification. In preferred embodiments, automatic microphone mixing for natural conversational communications is preferred, to allow and facilitate natural overlaps between active speakers or talkers in conversation. Further, when additional speakers or talkers enter the conversation, full duplex operation is preferred. Rather than a second talker having to "barge-in" by raising their voice over the heightened gain of the incumbent, both talkers can be active by decreasing the gain of the incumbent's speech volume by a certain number of decibels, for example 3 dB, while also increasing, decreasing, or maintaining the second speaker's gain at a similar level to that of the original speaker or talker. The cumulative effect is to maintain or at least control the total volume output to one level, while allowing additional talkers or speakers to join in the conversation without having to raise their volumes or the total volume of the conversation. This has the additional benefit of reducing the likelihood of possible acoustic feedback.

In some embodiments, the other microphones not designated as speaking microphones may be set to a listening mode to pick up the ambient noise surrounding the system and/or listening individuals. Once the ambient noise is detected, a cancellation signal (out of phase signal) is identified and may be added to the input channel of the speaking microphones, and/or emitted directly through one or more of the speakers to reduce the ambient noise surrounding the system as received by the individuals around the system. Various other embodiments may implement other as well as similar methods to capture and cancel noise not coming from the current speaking individual(s), these include the use of mic arrays in some instances, or even using a single microphone, to help improve the signal to noise ratio. Additionally, the signal from the microphone receiving the active talker can be phase inverted (polarity inversion) to attenuate the talker's voice from the microphones being used for ambient sound pickup for a more accurate sensing of ambient noise levels. When the out-of-phase polarity is added to the signal from the active talker's microphone(s), then the only sound signal left is the ambient sound. The integrated (from the non-talker pickup microphones) ambient noise level in the room can then modulate the overall gain of the system to maintain appropriate signal to noise ratio.

One way the system may distinguish audio input device(s) being used by speaking individuals can be by having a predetermined threshold value and setting priority values to each input audio device. The predetermined threshold(s) may be set up to respond to or be triggered by a specific frequency or range of frequencies and/or at specific amplitude(s) or levels of volume to control what sounds should or should not be relevant, and/or which sounds should be associated with what priority values or range of values. The priority value of each audio input device must meet a predetermined threshold to be classified as an audio input device associated to, with or near a speaking individual, i.e., a speaking microphone. If the threshold value is not met, then the audio input device may be designated as an inactive device, a listening device, a suppressed or muted device, or otherwise classified in any other manner or category that may be programmed. In some embodiments, the priority values of each audio input device may be used to determine the level of amplification, suppression, or other mode or instruction for that device. Importance of speaking individuals and assigned values may also be set by analysis of visual data as analyzed by the system capturing the movement and positions of the heads, faces, mouths and lips of individuals. The use of machine learning and other forms of artificial intelligence may also be employed to dynamically set and alter the assigned priority values, the factors and variables used to determine those values, such as sound frequencies, the predetermined threshold value and factors used to determine the threshold value.

Other embodiments of the system deploy methods for reducing background noise from the input signal relative to the desired speech or to otherwise improving the signal to noise ratio of the speaking individual's words, optimizing for intelligibility. Such methods include incorporating noise reduction algorithms. Such methods may also include band pass filtering the input signal to reduce acoustic energy outside of the frequency ranges of human speech or outside of ranges most important for speech intelligibility, such as between 500 Hz to 8 kHz or 1 kHz to 4 kHz. Such methods may also include speech separation algorithms.

One way of carrying this out is by having dynamic noise in a band modulate signal gain. The voice range from a speaking microphone is split into a number of bands, for example 4 or 5 bands, and the ambient noise in each band is measured in real time, the highest ambient noise measured in each band controls the signal gain for that individual band. This means that for each band, the voice gain can be increased in proportion to the level of ambient noise in that band without unnecessarily exceeding that level. Therefore, the signal gain may be increased in each band separately depending on the level of ambient noise in that individual band. Accordingly, when the noise in an individual band increases, so does the signal level in that band to match the level of the noise in that band. This allows the system to continuously maintain a highly intelligible total signal/noise ratio without unnecessarily increasing the total gain of the combined bands. Bands may be selected to coincide with the typical speech formant bands.

In various embodiments, methods are deployed that selectively control the output signal to specific listeners. For example, by preferentially amplifying the output signal for listeners that are identified as being further away from the speaking individual(s). Identification of listener(s) or their position relative to the speaking individual(s) may be carried out by any of the methods mentioned in this document, including voice detection through each mic and/or visual analysis by processing captured images of the listener(s) and their position relative to the speaking individual(s) using the one or more cameras or visual sensors. Each listener and/or output device may be assigned a value based on the distance from speaking individuals(s) and/or other output devices, and then adjusting the output signal of each output device based on the assigned values.

Some embodiments would also steer the output away from the speaking individual(s) and into the direction of the identified listeners. This serves to both amplify the output to the listeners and reduce the possibility of acoustic feedback, improving stability in the system. This could be done by using directional speakers and/or by automatically moving around or rotating speakers and output devices, and/or by amplifying some output devices while suppressing others.

Various embodiments of the system incorporate acoustic echo cancellation using techniques familiar to those skilled in the art. The goal here is to improve maximum gain along with stability of the system.

Some embodiments may also reduce acoustic feedback by deploying a feedback suppressor. Notch-type feedback suppressors may be used for dynamic filtering at certain ringing frequencies and similar filtering techniques known to those skilled in the art. Multiple fixed and dynamic filters may be used simultaneously. Furthermore, a frequency shifter (typically 4 to 5 Hz) may be used in conjunction with the notch suppressor, in some embodiments these are placed in series to provide extra gain before feedback. The frequency shifter is active on the onset of feedback when the dynamic notch filter reaches its stability limits and then both the frequency shifter and dynamic notch filter are both active.

Various embodiments of the system deploy methods of voice intelligibility processing and signal processing preceding the amplifier to accentuate and improve the intelligibility of consonants. This will improve intelligibility by focusing on specific sounds produced that are the most significant for the comprehension of the listener(s). The processing control unit receives the signal from a microphone, preferably one determined to be nearest to a speaking individual, whereby the processor then identifies and increases the peak point of formants. As known to those skilled in the art, formants may be defined as "the spectral peaks of the sound spectrum" or a broad peak in the spectral envelope of the sound, in this instance the sound being a voice of the speaking individual. The processing control unit can identify the formant in a speaking individual's voice by using dynamic equalization, which only activates when the signal reaches a certain threshold, modulated by the ambient noise and the formant.

A closely related method that may be deployed in some embodiments, is peak unlimiting, which may also be utilized to amplify consonants of a speaking individual. This technique may be implemented in analog, expanding peaks in the formant range by a ratio of 2:1 over a very narrow dynamic range increasing the intelligibility of the consonants. Other techniques may also be deployed by the system to increase intelligibility while maintaining lower gains in vowels, these include peak unlimiter attack times, that may use a 2-step inflection point attack and release times, as well as the use of multi-band peak unlimiters simultaneously. Because these techniques may be undertaken in analog, issues with latency are reduced substantially.

Various embodiments also incorporate system design techniques to minimize signal latency throughout the signal's path in the system. In many embodiments of the system, the use of analog wherever possible throughout the system is preferred since it maybe the simplest method to ensure low latency. The system may also implement digital control of analog filters, bi-quads and other low latency circuitry solutions well known to those skilled in the art.

In some embodiments, artificial intelligence is used to detect the speaking individual(s), listening individuals, assigning priority values, dynamically detecting formants, noise or signals in different bands, selecting and/or designating the audio input devices to capture speech or other sounds and noise, canceling ambient noise or echo, and/or dynamically directing the array of audio output devices towards listeners throughout the conversation. As data is captured by the processing control unit, it may dynamically carry out any of these methodologies to improve speech intelligibility using techniques including and not limited to pre-set values, machine learning and related methods known to those skilled in the art.

In various embodiments the voice accentuation system is coupled with voice accentuation control application software that can be run or executed on any type of computing device such as a smart phone, tablet, wearable technologies including wearable glasses, earbuds, watches as well as notebooks and personal computers. In some embodiments, each user that is connected to the system, wirelessly or otherwise, may mix the audio they are receiving from the system via the application software. The application may present users with an audio mixer that allows configuration of different ranges of frequencies, volumes, directionality of speakers or microphones and the like. One device may be set as a master device to override any configuration(s) set by the other devices.

In some embodiments, users may connect to the device via personal sound input and/or output device(s)/sources including, microphones, loudspeakers, or wireless audio headsets, and the application allows the users to modify or select the sounds they wish to accentuate or hear and the sounds they wish to suppress, mute, or otherwise remove. The voice accentuation control application may also detect individual and/or group talkers and present the option to users to accentuate, mute, or suppress sounds from specific individuals or groups. In various embodiments the device may also isolate specific sounds, such as clatter, clinking glasses, noise from the streets or nearby vehicles and allow users to select or preset which sounds they wish to hear and/or accentuate, and which sounds they wish to mute or suppress. In various embodiments some sounds are associated with certain individuals or groups, and may also be suppressed or accentuated by users.

The system may present to the user preset settings for different environments, via the application or through selections or buttons on the voice accentuation device or system. Preset settings may tune the settings of the system and control of the different variables to optimize the system and/or device for the chosen environment. In various embodiments the system may preset these setting automatically upon detecting the location of the user and/or the device itself. In various embodiments the system automatically detects, identifies the environment, setting, users, or individuals in a group using, around or otherwise near the device. It could do so via preset settings, prior connections to the device, machine learning algorithms that recognize specific individuals, connection to or identification of client devices, sounds, locations and/or environments. In these embodiments the system may automatically adjust, modify, add, and remove these sources of sound to provide the most intelligible speech sounds for a group.

The device and/or system may also be utilized by, plugged into and incorporated with other application software systems and device including third party software. Applications and software directly installed and belonging solely to the device and/or system may also be utilized. One example of these native or third-party applications is an online ordering system whereas orders may be made through the system/device using voice recognition. In some embodiments a virtual assistance may utilize voice recognition algorithms, this may include native or third party connected applications, including Google Assistance, Siri and Alexa, which may all be used with, or incorporated into the system/device for an ordering or shopping system or for other queries and online searches, media consumption and activities.

In several embodiments the system allows for, or carries out automatic volume adjustment, in addition to allowing for adjustments manually. Volume may be controlled by adjusting the output speaker volumes to appropriate levels relative to conversation and ambient noise volumes. In some embodiments the level of gain on each microphone may be adjusted to increase input levels from specific input channels but not others. The system may limit the frequencies of sounds it picks up (for example to between 100 Hz-800 Hz) or limit the frequencies that sounds, or voices are accentuated to (for example to 800 Hz to 6 KHz).

In various embodiments, a "fork filter" method is incorporated into the system, where the system can respond to sudden short bursts of sound such as forks clattering on a plate, a shout, breaking of dropped glasses and the like that occur near active audio input devices/sources. As soon as a burst of sound is detected, the system automatically lowers the gain of the audio input source(s) that are affected, this could be for a very short amount of time like a few tenths of a second, or if the sudden noise remains it could maintain the low gain or reduce it even further for a longer period. The system is also able to respond to audio input overload at each audio input device by disabling the audio path of the overloaded input device. In some embodiments the system can reduce the range by which it picks up sound, for example if ambient noise is very loud at 2.5 meters, or any specific distance, then the system will not pick up sounds from that distance and further outwards from it.

The methods presented in this document may be combined with other sound control, synthesis, detection, noise and/or echo cancellation, voice and speech accentuation and reinforcement methods and/or embodiments of the system or be practiced on their own.

While the present technology is susceptible of embodiment in many different forms, there is shown in the drawings and will herein be described in detail several specific embodiments with the understanding that the present disclosure is to be considered as an exemplification of the principles of the present technology and is not intended to limit the technology to the embodiments illustrated.

FIG. 1 illustrates an exemplary generalized architecture for practicing some embodiments of the system for dynamic voice accentuation and reinforcement.

The voice accentuation and reinforcement system 110 may be a tabletop, attached to the ceiling, wall or beneath the table or on the ground system. In preferred embodiments the system may be or may include a primary central voice accentuation device that is preferably placed between members of a conversing group. In this exemplary illustration the voice accentuation system 110 is placed between speaking individual 101, speaking individual 102 and listeners 105. Audio input signals 115 from the speaking individuals 101 and the speaking individual 102 are received by audio input device(s) 130 that are placed in, on or near the voice accentuation system 110, and may face radially outward towards the individuals 101, 102 and 105. Output audio signals 120 may be emitted by audio output device(s) 140 to the speaking individuals 101 and 102 and listeners 105 depending on audibility requirements. Audio input device(s) 130, visual input device(s) 135 and audio output device(s) 140 may also be placed separately, or away from the system (for example overhead or across different placements in the room) and may be connected wirelessly or directly through wired connections to the voice accentuation system 110. The voice accentuation system 110 can provide the functionality of the system and all its embodiments as described throughout this document.

FIG. 2 is a flowchart representation of method 200 to improve the intelligibility of speaking individuals. Once individual(s) are speaking around the system (current speaker), the speaker(s) are detected by the system 205. At least one audio input device or microphone is selected to capture the speech of the current speaker(s) 210. At least one further audio input device is then selected to capture noise or sounds not coming from the current speaker(s) 215. The noise captured by the further audio input device is cancelled 220, this may be done by adding an out of phase signal to the input signal from the current speaker(s). Finally, the input signal captured from the current speaker(s) is optimized for intelligibility 225.

FIG. 3 is a diagrammatic representation of an example embodiment of a dynamic voice accentuation and reinforcement system 300. The system can perform any one or more of the methodologies discussed herein. In various example embodiments, the system 300 operates as a standalone device, or may be connected (e.g., networked, or placed in a master-slave configuration) with one or more similar systems or embodiments of the system 300. The system includes a processing control unit 310 which may include any one or more of the following: a frame grabber 320, a multichannel analog to digital converter 350, a multichannel digital to analog converter 360, an optional preamplifier 370, an optional wireless transmitter 380, an audio processing unit 390 and a video processing unit 395.

The system 300 may also include any one or more of the following; audio input device(s) 330, which may include microphones, cellphones or other audio sensors or audio capture technologies and devices, video input device(s) 335, which may include cameras, video recorders, cellphones, tablets, or other visual sensors, visual data capture technologies and devices, and audio output device(s) 340, which may include any type of speaker, or device capable of outputting sound such as a handheld device, computing device, tablet or similar technologies and devices. The system 300 may utilize the optional wireless transmitter 380, such as a Bluetooth transmitter to connect wirelessly to other systems, input/output devices, including audio input device(s) 330, video input device(s) 335 and audio output device(s) 340 and the like, and facilitate the movement of input and output data, signals and instructions from connected audio input device(s) 330, video input device(s) 335 and audio output device(s) 340 and the like to and from the audio processing unit 390 and/or the video processing unit 395.

As signals are picked up by audio input device(s) 330 they may be amplified into a line signal if necessary by optional preamplifier 370, otherwise they would be input into a multichannel analog to digital converter 350, where the analog signal is converted into a digital signal capable of being processed by audio processing unit 390, which undertakes many of the methodologies described in the document, including but not limited to detecting and/or determining of the location of speaking individuals, the location of listeners, the assigning of values, the assigning of instructions and/or priorities, or the setting of modes for audio input device(s) 330, video input device(s) 335 and audio output device(s) 340, and providing instructions to amplify, suppress, mute any audio input device(s) 330, video input device(s) 335 and audio output device(s) 340.

The audio processing unit or the voice accentuation device may also synthesize, isolate sound bands, identify speech patterns, undertake equalization, modify signals, and may also pass data back and forth to a video processing unit 395. The video processing unit 395 may also analyze data captured from the one or more video input device(s) 335 and frames captured by frame grabber 320. The video processing unit may also determine the location and status of speakers and/or listeners by analyzing captured images, video recordings, and related image data of the movement of the head, face, lips, neck, and mouth of individuals near the system. The video processing unit may also determine whether a person is near the system based on captured visual data. The video processing unit 395 and the audio processing unit 390 may work together or independently and may share raw and analyzed data with each other. Finally, after processing is complete, the audio processing unit 390 may send a digital signal to multichannel digital to analog converter 360 which sends analog audio signals to one or more of the audio output device(s) 340 which output the signal accordingly.

FIG. 4 presents one embodiment of a method 400 to improve intelligibility and minimize ambient noise. The system, and in some embodiments the voice accentuation device, assigns priority values to each audio input device when the system/device is activated. These priority values are based on the type of audio signal received. The system may assign higher priority values to audio input sources that receive audio signals within one or more frequencies or frequency ranges and/or be at specific volume(s) or volume ranges. As a non-limiting example, the system may assign the highest priority values to audio input device(s) that contain the loudest sounds in the frequency range for human voices i.e., 80-300 Hz.

The system may also determine the location 410 via GPS, ultrawide bands or other triangulation means. In various embodiments, the determining of the location of the system may affect the prioritization of the types and volumes of sounds captured or produced by the system, as well as any classification priority values the system assigns to each input or output source. One example of this to compare how the system would function in a restaurant compared to a board room environment. The former likely to prioritize louder speech output volumes than the latter with a higher emphasis on reducing ambient sounds. This may result in requiring higher signals of sound in the human vocal range for an audio input device to be classified as vocal/speech audio input source and receive priority values classifying it as such. Determining the location may also trigger preset or default sound input and output settings for the device or system. These settings may be set by the system based on pattern recognition over time, by the user, or come preloaded.

The system may then determine or identify 420 speaking individual(s) around the system based on captured frequencies at certain amplitudes. Both 410 and 420 can lead to updating the priority values assigned to each audio input device, which can affect the gain of each input device, for example, both priority values and gain increasing if associated with speaking individuals ("speaking input device") or decreasing if associated with ambient noise ("ambient noise input device"). In various embodiments the system may also determine the priority value of each individual around or near the system, where the microphones or audio input sources near individuals engaged in more vigorous or intense conversations, receiving a higher priority value that sets that audio input source to have higher gain. These assignments and classifications could be done via audio capture, where spoken voices are assigned higher values, or be done via image capture devices, including cameras that capture frames to identify individuals that are speaking, i.e., gesturing individuals or ones where many other users are turned towards may be given higher priority values than those sitting passively.

For those audio input devices that don't meet the threshold requirements of being assigned a priority value of a speech input device, they are set to be ambient listening devices. These detect 425 ambient noises from the environment. And based on the ambient noise detected, one or more cancellation signals are determined 430 (signals of inverted polarity to the ambient noise signal for example) and are added 435 to the input channel(s) of one or more of the speech/vocal audio input devices. The gain of each input device may then be automatically and dynamically adjusted 440 accordingly. An output signal that is clear and with minimal ambient noise is emitted 445 from loudspeakers or other audio output devices. In various embodiments the assigned priority values of each audio input device may be dynamically updated by changes in the detected sounds, locations, environmental conditions, and other variables, for example as a result of steps 410, 415, 420, and 440. In various embodiments total ambient volume may be calculated by using total ambient noise from all audio input devices, while in other embodiments only select audio input devices are used, or ambient noise values from each input device remains separate from the others.

FIGS. 5A-5B present different views of one embodiment of the voice accentuation device 500. FIG. 5A presents a frontal view of the device 500 which includes a power button or switch 505, that may be of various shapes or sizes, and may be either flush with, or protruding from the voice accentuation device 500. One or more LED lights 510 can be included and may be used to indicate the device's 500 on/off, mute/unmute, and/or volume level status. The device may also include a charging and connection port 502 that could use a USB-C or other protocol.

FIG. 5B presents a top view of the device showing the device cover 525 that secures the computing, control, or processing unit(s) along with the power source in the device 500. The device may include one or more of the following active pressable buttons or switches: an increase volume/volume up/unmute button 520, a decrease volume/volume down button 525, a wake up or mute button 530 and a sleep button 535. The device may be turned on via the power button 505 in FIG. 5A and may go into sleep or low power mode automatically upon determining that there is no conversation taking place. The device may also go into a low power or sleep mode manually via pressing sleep button 535. The device may be muted via button 530 and unmuted via button 520.

FIGS. 6A-6B present another embodiment of a method 600 to improve intelligibility and minimize ambient noise in a conversation setting. FIG. 6A presents the method 600 which may begin by differentiating 605 between audio input sources as those that are near or picking up speech or human vocal sounds (referred to herein as "vocal/speech sound audio input sources", "vocal/speech sound inputs", or "vocal/speech sound input sources"), and those that are picking up or are near ambient noise (referred to herein as "ambient noise audio input sources", "ambient noise inputs", or "ambient noise input sources"). In some embodiments these audio input sources are set in this classification for the full user session, while in others these classifications are changeable throughout a use session. Optionally, the locations of individuals that are speaking and those that are listening may be determined 610, these locations may be updated dynamically as individuals move around the system. Further, the system may associate 615 certain audio input sources to speaking individuals or groups and/or associate 615 certain audio output sources to listening individuals or groups. These associations may be updated dynamically and may factor in as a variable in controlling and adjusting sound input and output sources.

In various embodiments, band pass filtering is activated 620 for one or more of the audio input sources, this could be limited to only one type of audio input sources i.e., ambient noise or human speech input sources or could be for any one or more audio input sources. The received audio signals from speech audio inputs are divided 625 into a number of bands, the ambient noise level of each band is measured 630, and then a signal gain in each band is adjusted 635 based on the ambient noise level of that band. This adjustment ensures that a uniform speech to ambient noise ratio is maintained across all bands, for example adjusting the gain for speech frequencies in each band to maintain exemplary a 2:1 ratio between speech and ambient noise. Replicating this across all the bands, allows uniform increases 640 in the total gain of all bands to increase the volume produced by the system while maintaining the same speech/noise ratio.

Many embodiments also incorporate a technique to invert the polarity 645 of ambient noise signals in any number of the audio input sources. This out-of-phase or inverted polar inverted ambient noise signal is added 650 to output sources such as the loudspeakers to cancel the ambient noise sounds emitted. This could be done on an individual output source basis, with each speaker adding 650 a specific inverted signal from a specific input source, or uniformly across all speakers, with all output signals adding 650 the same inverted signal. Inverted ambient sounds signals may also be added 650 to the channels of input devices. The ambient noise signals may be captured from one or more of the audio inputs including from either ambient noise or speech sound input sources. In some embodiments the ambient noise detected in each vocal/speech sound audio input source is isolated and then inverted 645 and added 650 to the signal of that specific input source. In some embodiments the inverted ambient noise signal is based on captured sounds from ambient noise audio inputs that are then inverted 645 and added 650 to the input channel of the vocal sound audio inputs.

In some embodiments, it is the vocal/speech audio signals from the vocal audio inputs that have their polarity inverted and added 680 to either the signals of input or output channels, to cancel out vocal or speech sounds to better detect ambient noise (FIG. 6B).

FIG. 6B presents other steps that may be deployed in various embodiments of method 600; the consonants in the input signals of vocal/speech audio input sources can be identified 655, and then amplified 660. The system and methods discussed herein may also expand peaks in the formant range by specific ratio, for example a ratio of 2:1 ($\Delta y/\Delta x$).

Many other optional steps may also be incorporated into the systems and methods discussed, including muting, or decreasing the gain of any or all audio input sources upon detection of a sudden and/or sharp increase in sound volume 670. Ambient noise audio inputs may also be muted 675 when the system is active. Audio input sources may also be set to a listening mode to only pick up and detect ambient noise 685. Audio input sources and audio output sources may also be associated to certain individuals or groups, or classified, for example such as vocal or ambient audio input sources by visual sensors, cameras, and visual image frame analysis 690. Finally, in various embodiments the system may dynamically and automatically adjust volume(s) of audio output sources and gain of audio input sources, including to improve intelligibility and minimize ambient noise.

FIG. 7 is a diagrammatic representation of an example machine in the form of a computer system 1, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1 includes a processor or multiple processor(s) 5 (e.g., a central processing unit (CPU), a graphics processing unit (GPU), or both), and a main memory 10 and static memory 15, which communicate with each other via a bus 20. The computer system 1 may further include a video display 35 (e.g., a liquid crystal display (LCD)). The computer system 1 may also include an alpha-numeric input device(s) 30 (e.g., a keyboard), a cursor control device (e.g., a mouse), a voice recognition or biometric verification unit (not shown), a drive unit 37 (also referred to as disk drive unit), a signal generation device 40 (e.g., a speaker), and a network interface device 45. The computer system 1 may further include a data encryption module (not shown) to encrypt data.

The disk drive unit 37 includes a computer or machine-readable medium 50 on which is stored one or more sets of instructions and data structures (e.g., instructions 55) embodying or utilizing any one or more of the methodologies or functions described herein. The instructions 55 may also reside, completely or at least partially, within the main memory 10 and/or within the processor(s) 5 during execution thereof by the computer system 1. The main memory 10 and the processor(s) 5 may also constitute machine-readable media.

The instructions 55 may further be transmitted or received over a network via the network interface device 45 utilizing any one of a number of well-known transfer protocols (e.g., Hyper Text Transfer Protocol (HTTP)). While the machine-readable medium 50 is shown in an example embodiment to be a single medium, the term "computer-readable medium"

should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

One skilled in the art will recognize that Internet service may be configured to provide Internet access to one or more computing devices that are coupled to the Internet service, and that the computing devices may include one or more processors, buses, memory devices, display devices, input/output devices, and the like. Furthermore, those skilled in the art may appreciate that the Internet service may be coupled to one or more databases, repositories, servers, and the like, which may be utilized in order to implement any of the embodiments of the disclosure as described herein.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

While specific embodiments of, and examples for, the system are described above for illustrative purposes, various equivalent modifications are possible within the scope of the system, as those skilled in the relevant art will recognize. For example, while processes or steps are presented in a given order, alternative embodiments may perform routines having steps in a different order, and some processes or steps may be deleted, moved, added, subdivided, combined, and/or modified to provide alternative or sub-combinations. Each of these processes or steps may be implemented in a variety of different ways. Also, while processes or steps are at times shown as being performed in series, these processes or steps may instead be performed in parallel or may be performed at different times.

While various embodiments have been described above, they are presented as examples only, and not as a limitation. The descriptions are not intended to limit the scope of the present technology to the forms set forth herein. To the contrary, the present descriptions are intended to cover such alternatives, modifications, and equivalents as may be included within the spirit and scope of the present technology as appreciated by one of ordinary skill in the art. Thus, the breadth and scope of a preferred embodiment should not be limited by any of the above-described exemplary embodiments.

While specific embodiments of, and examples for, the system are described above for illustrative purposes, various equivalent modifications are possible within the scope of the system, as those skilled in the relevant art will recognize. For example, while processes or steps are presented in a given order, alternative embodiments may perform routines having steps in a different order, and some processes or steps may be deleted, moved, added, subdivided, combined, and/or modified to provide alternative or sub-combinations. Each of these processes or steps may be implemented in a variety of different ways. Also, while processes or steps are at times shown as being performed in series, these processes or steps may instead be performed in parallel or may be performed at different times.

The various embodiments described above, are presented as examples only, and not as a limitation. The descriptions are not intended to limit the scope of the present technology to the forms set forth herein. To the contrary, the present descriptions are intended to cover such alternatives, modifications, and equivalents as may be included within the spirit and scope of the present technology as appreciated by one of ordinary skill in the art. Thus, the breadth and scope of a preferred embodiment should not be limited by any of the above-described exemplary embodiments.

What is claimed is:

1. A system for improving speech intelligibility in a group setting, the system comprising:

a plurality of audio input sources;

one or more audio output sources;

one or more audio filters; and a processing control unit, the processing control unit coupled to the plurality of audio input sources and the one or more audio output sources, the processing control unit comprising:

an audio processing unit, to process audio input signals to audio output signals;

wherein the processing control unit executes a method to improve speech intelligibility, the method comprising:

differentiating between the plurality of audio input sources as vocal sound audio input sources and ambient noise audio input sources by having a predetermined threshold value and setting priority values to each of the plurality of audio input sources;

wherein the setting priority values to each of the plurality of audio input sources comprises using image capture devices to identify a speaking individual and a sitting individual and setting the priority values of the vocal sound audio input sources near the speaking individual higher than the priority values of the ambient noise audio input sources that are near the sitting individual;

increasing a gain of the vocal sound audio input sources;

inverting a polarity of an ambient sound received by each of the ambient noise audio input sources; and adding the inverted polarity to an output signal of the one or more audio output sources to reduce ambient sound, the adding the inverted polarity done on an individual output source basis, with each of the one or more audio output sources adding a specific inverted signal from a specific ambient noise audio input source of the ambient noise audio input sources.

2. The system of claim 1, wherein the system further comprises one or more of any of a preamplifier, a network interface, a digital signal processor, a power source, an automatic microphone mixer, a notch-type feedback suppressor, a multichannel digital to analog converter, a multichannel analog to digital converter, one or more visual sensors, a frame grabber, a band pass audio filter, a notch audio filter, a high-pass audio filter, a low-pass audio filter, a video processing unit, and a wireless transmitter, wherein the predetermined threshold value is one of a specific frequency or range of frequencies, a specific frequency or range of frequencies at specific amplitude(s), and sounds associated with priority values or range of values.

3. A voice accentuation device for improving speech intelligibility in a group setting, the device comprising:

one or more audio input sources, wherein each of the one or more audio input sources may be associated with one or more individuals;

one or more audio output sources, wherein each of the one or more audio output sources may be associated with one or more individuals and may each have an output signal amplified if the associated one or more individuals are actively listening;

one or more band pass filters;

a processing control unit, the processing control unit coupled to the one or more audio input sources and the one or more audio output sources, wherein the processing control unit executes a method to improve speech intelligibility, the method comprising:

differentiating between the one or more audio input sources as vocal sound audio input sources and ambient noise audio input sources by having a predetermined threshold value and setting priority values to each of the one or more audio input sources;

wherein the setting priority values to each of the plurality of audio input sources comprises using image capture devices to identify a speaking individual and a sitting individual and setting the priority values of the vocal sound audio input sources near the speaking individual higher than the priority values of the ambient noise audio input sources that are near the sitting individual;

increasing a gain of the vocal sound audio input sources;

inverting a polarity of an ambient noise signal received by each of the ambient noise audio input sources; and adding the inverted polarity to an output signal of the one or more audio output sources to reduce ambient noise, the adding the inverted polarity done on an individual output source basis, with each of the one or more audio output sources adding a specific inverted signal from a specific ambient noise audio input source of the ambient noise audio input sources; and an audio processing unit, to process audio input signals to audio output signals, wherein the audio processing unit may be part of the processing control unit or otherwise connected to the processing control unit.

4. The device of claim 3 wherein the audio processing unit comprises a digital signal processor.

5. The device of claim 3 wherein the audio processing unit comprises:

a multichannel digital to analog converter, connected to the audio processing unit; and a multichannel analog to digital converter, connected to the audio processing unit.

6. The device of claim 3 wherein the processing control unit further comprises:

one or more visual sensors;

a frame grabber connected to the one or more visual sensors; and a video processing unit connected to the frame grabber, wherein the video processing unit is configured to use frame data from the frame grabber in setting the priority values.

7. The device of claim 3 wherein the device further comprises one or more of any of a preamplifier, a network interface, a digital signal processor, a power source, an automatic microphone mixer, a notch-type feedback suppressor, a notch audio filter, a high-pass audio filter, a low-pass audio filter and a wireless transmitter, wherein the predetermined threshold value is one of a specific frequency or range of frequencies, a specific frequency or range of frequencies at specific amplitude(s), and sounds associated with priority values or range of values.

8. The device of claim 3 wherein the differentiating in the method executed by the processing control unit, comprises:

comparing a gain pickup from each of the one or more audio input sources;

analyzing a sound signal from each of the one or more audio input sources to determine whether the sound signal falls within predetermined frequencies; and determining whether each of the one or more audio input sources is picking up vocal sounds or ambient noise.

9. The device of claim 3 wherein the adding the inverted polarity done on the individual output source basis comprises: each of the one or more audio output sources adding the specific inverted signal from a specific ambient noise audio input source of the ambient noise audio input sources from a same direction that each of the one or more audio output sources is facing.

10. The device of claim 3 wherein the method executed by the processing control unit further comprises muting the ambient noise audio input sources.

11. The device of claim 3 wherein the method executed by the processing control unit further comprises setting the ambient noise audio input sources to a listening mode to only pick up ambient noise surrounding the device.

12. The device of claim 3 wherein the method executed by the processing control unit further comprises:

inverting a polarity of a signal received by one or more of the vocal sound audio input sources and adding the inverting of the polarity of the signal received by one or more of the vocal sound audio input sources to the signal received by the one or more of the vocal sound audio input sources, to better isolate ambient noise from vocal sounds; and modulating the gain of the one or more audio input sources based on the isolated ambient sounds, to improve signal to noise ratios.

13. The device of claim 3 wherein the method executed by the processing control unit further comprises:

dividing a sound signal received from at least one of the vocal sound audio input sources into a plurality of bands;

measuring an ambient noise level in each band of the plurality of bands in real time; and adjusting a signal gain in each band of the plurality of bands based on the measured corresponding ambient noise level to maintain a uniform signal to ambient noise ratio across the plurality of bands.

14. The device of claim 3 wherein the method executed by the processing control unit further comprises:

band pass filtering input signals from the one or more audio input sources to reduce acoustic energy outside of frequency ranges of human speech.

15. The device of claim 3 wherein the method executed by the processing control unit further comprises:

identifying a peak point of formants of an input signal of at least one of the vocal sound audio input sources; and increasing the peak point of the formants.

16. The device of claim 3 wherein the method executed by the processing control unit further comprises:

identifying consonants in an input signal of at least one of the vocal sound audio input sources;

amplifying the consonants in the input signal of the at least one of the vocal sound audio input sources; and expanding peaks in a range of the formant by a ratio of 2:1 over a specific portion of dynamic range increasing intelligibility of the consonants.

17. The device of claim 3 wherein the method executed by the processing control unit further comprises:

minimizing the gain of any of the audio input sources when a sharp sudden increase in amplitude is detected.

18. A method for improving speech intelligibility in a group setting, the method comprising:

differentiating between a plurality of audio input sources comprising: vocal sound audio input sources and ambient noise audio input sources by having a predetermined threshold value and setting priority values to each of the plurality of audio input sources, wherein the predetermined threshold value is one of a specific frequency or range of frequencies, a specific frequency or range of frequencies at specific amplitude(s), and sounds associated with priority values or range of values;

wherein the setting priority values to each of the plurality of audio input sources comprises using image capture devices to identify a speaking individual and a sitting individual and setting the priority values of the vocal sound audio input sources near the speaking individual higher than the priority values of the ambient noise audio input sources that are near the sitting individual;

dividing a sound signal received from at least one of the vocal sound audio input sources into a plurality of bands;

measuring an ambient noise level in each band of the plurality of bands in real time;

adjusting a signal gain in each band of the plurality of bands based on the measured corresponding ambient noise level to maintain a uniform signal to ambient noise ratio across the plurality of bands;

increasing a signal gain of the vocal sound audio input sources;

inverting a polarity of an ambient sound received by the ambient noise audio input sources; and adding the inverted polarity to one or more audio output sources to reduce ambient noise, the adding the inverted polarity done on an individual output source basis, with each of the one or more audio output sources adding a specific inverted signal from a specific ambient noise audio input source of the ambient noise audio input sources.

19. The method of claim 18 wherein the differentiating, comprises:

comparing a gain pickup between the audio input sources;

analyzing a sound signal from each of the audio input sources to determine whether the sound signal falls within predetermined frequencies; and determine whether each of the audio input sources is picking up vocal sounds or ambient noise.

20. The method of claim 18 wherein the method further comprises:

band pass filtering input signals from the plurality of audio input sources to reduce acoustic energy outside of frequency ranges of human speech.

21. The method of claim 18 wherein the method further comprises:

identifying a peak point of formants of an input signal of at least one of the vocal sound audio input sources; and increasing the peak point of the formants.

22. The method of claim 18 wherein the method further comprises:

identifying consonants in an input signal of at least one of the vocal sound audio input sources;

amplifying consonants in the input signal of the at least one of the vocal sound audio input sources; and expanding peaks in a range of the formant by a ratio of 1.1 or more increasing the intelligibility of the consonants.

* * * * *